United States Patent [19]

Itaya et al.

[11] Patent Number: 4,876,576

[45] Date of Patent: Oct. 24, 1989

[54] DEVICE FOR CHANGING SHEET SHAPE BEFORE ENTRY INTO FUSER NIP

[75] Inventors: Keiji Itaya, Yokohoma; Hiromasa Kohayakawa, Tokyo, both of Japan

[73] Assignee: Kabushiki Kaisha Toshiba, Kawasaki, Japan

[21] Appl. No.: 184,414

[22] Filed: Apr. 21, 1988

[30] Foreign Application Priority Data

Apr. 25, 1987 [JP] Japan ..... 62-102792
Apr. 30, 1987 [JP] Japan ..... 62-106853

[51] Int. Cl.[4] ..... G03G 15/00

[52] U.S. Cl. ..... 355/285; 219/216; 355/311

[58] Field of Search ..... 355/3 FU, 14 FU; 271/161, 188, 209; 219/216; 432/60

[56] References Cited

U.S. PATENT DOCUMENTS 3,240,490 3/1966 Fairbanks et al. ..... 271/188 X
3,884,623 5/1975 Slack ..... 219/216 X
4,378,152 3/1983 Edwards et al. ..... 355/3 FU
4,693,587 9/1987 Shigenobu et al. ..... 355/3 FU

OTHER PUBLICATIONS

Kobus; Xerox Disclosure Journal; vol. 6, No. 5; Sep.-/Oct. 1981.

*Primary Examiner*—A. T. Grimley
*Assistant Examiner*—Robert Beatty
*Attorney, Agent, or Firm*—Foley & Lardner, Schwartz, Jeffery, Schwaab, Mack, Blumenthal & Evans

[57] ABSTRACT

A fixing device is provided in an image forming apparatus. The fixing device has first and second rollers to form a nip portion therebetween. An image forming medium having a flat shape and a leading edge, on which an unfixed image is formed. The image forming medium is conveyed and approaches the nip portion between the first and second rollers. The fixing device also has a changing unit for changing the shape of the vicinity of the leading edge of the image forming medium from the flat shape to a convex shape while the image forming medium is being conveyed to approach the nip portion.

7 Claims, 5 Drawing Sheets

DEVICE FOR CHANGING SHEET SHAPE BEFORE ENTRY INTO FUSER NIP

BACKGROUND OF THE INVENTION

1. Field of the Invention

The present invention relates to an improvement in a fixing device for an image forming apparatus which is used to fix a toner image on an image forming medium such as a sheet of paper passed between a heating roller and a supporting roller.

2. Description of the Prior Art

Generally, in an image forming apparatus, a sheet of paper, such as the image forming medium onto which a toner image has been transferred, is conveyed to a fixing device after having been peeled from a photosensitive drum, and a fixing operation is carried out. In order to fix the toner image on the paper, the fixing device comprises a roller pair including a fixing roller and a pressing roller forming a nip portion therebetween. Hitherto, when the paper passed through the roller pair, creases occurred in the paper caused by the roller pair.

Utility Model Application Laid Open under No. 123955/1980, Utility Model Application Publication Nos. 9806/1985 and 14284/1985 in Japan are directed to solve this problem. In these applications, a method of preventing paper creases calls for guiding the paper which had been fed to the entry to the roller pair and, at the same time, providing a paper guide plate with its center in the lengthwise direction of the roller pair of a higher convex shape than both side edges. The paper conveyed on the paper guide plate was fed to the roller pair in such a way that both edges were lower than the center.

However, even by this method, in cases where the leading edge of the paper curls, as shown in FIG. 10A, it is not often that both side edges of the paper fall lower than the center portion when following the paper guide plate under the paper's own weight alone. In particular, in cases of copying on both sides of the paper or multiple copying on the same side of the paper, in which a toner image is fixed a second time onto the paper which has already once been developed and fixed, a curl will occur at the leading edge of the paper and the paper will not be fed correctly to the roller pair for the second copying operation. Therefore, there is the problem of creases occurring and, in the worst case, of the occurrence of paper jamming at the roller pair.

SUMMARY OF THE INVENTION

Accordingly, it is an object of the present invention to provide a fixing device for an image forming apparatus in which the drawbacks of the prior art mentioned above have been eliminated.

Specifically, it is an object of the present invention to provide a fixing device for an image forming apparatus, which prevents creases occurring in an image forming medium by the image forming medium being forced into the convex shape.

According to one aspect of the present invention, there is provided a fixing device for an image forming apparatus, comprising first and second rollers forming a nip portion therebetween; means for conveying an image forming medium having a flat shape and a leading edge approaching the nip portion, on which an unfixed image is formed; and means for changing the shape of the vicinity of the leading edge of the image forming medium from the flat shape to a convex shape while the image forming medium is being conveyed to approach the nip portion by the conveying means.

BRIEF DESCRIPTION OF THE DRAWINGS

These and other objects and advantages of this invention will become more apparent and more readily appreciated from the following detailed description of the presently preferred exemplary embodiments, taken in conjunction with the accompanying drawings of which:

FIGS. 7 and 9 show a third embodiment of the present invention in which:

FIG. 7 is a side view showing the essential part of a fixing device;

FIG. 9 is a schematic view showing the mechanism of a pushing means;

DETAILED DESCRIPTION OF THE PREFERRED EMBODIMENTS

An embodiment of a fixing device according to the present invention will now be described with reference to the drawings.

Figure 1:
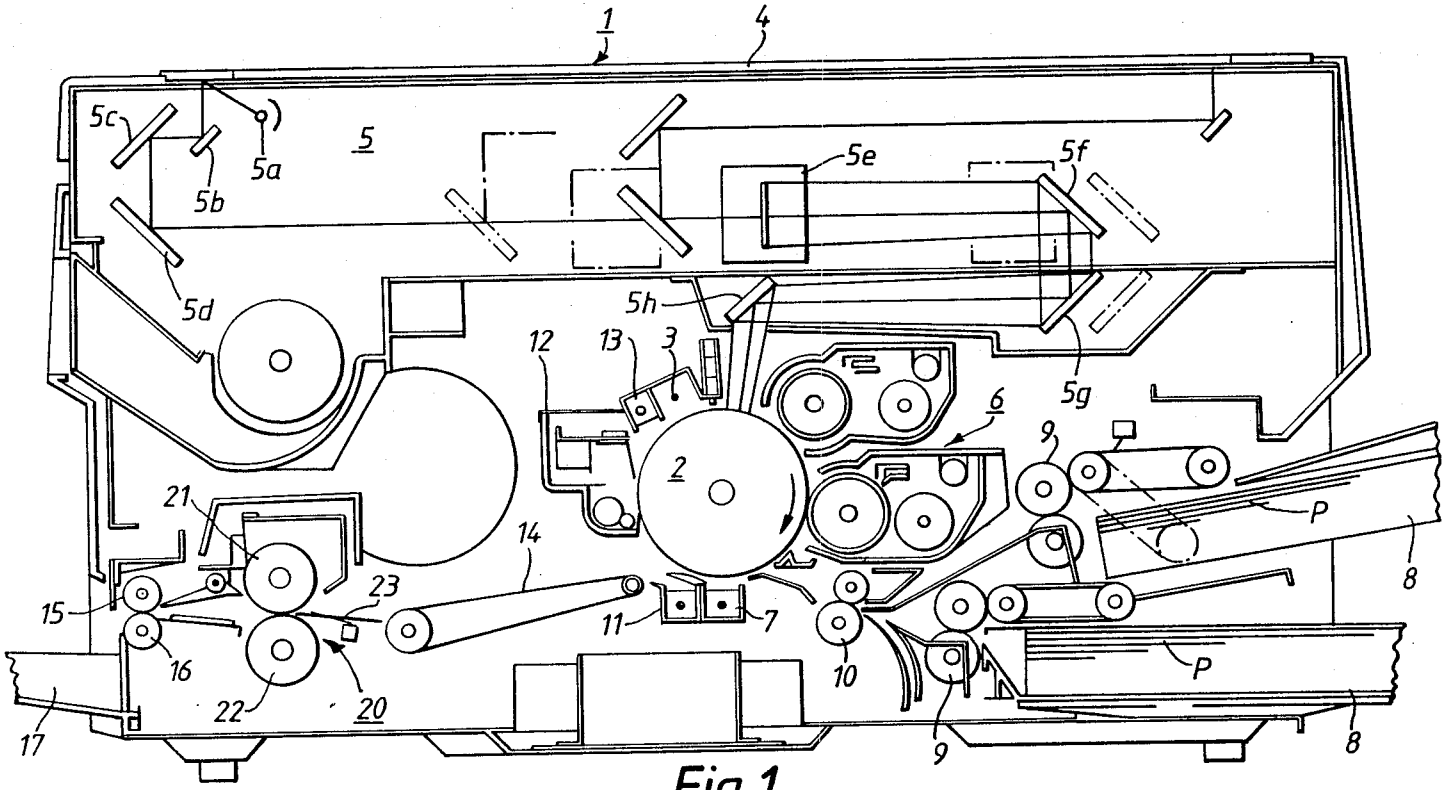
FIG. 1 is a cross-sectional view showing an image forming apparatus using a fixing device according the present invention.

FIG. 1 shows the simplified overall construction of an electronic copying machine which is an image forming apparatus fitted with the fixing device of the present invention. A photosensitive drum 2 is mounted on a shaft so that it is free to rotate approximately at the center of a main body 1. Photosensitive drum 2 is designed to be uniformly charged by a main charger 3. An electrostatic latent image is formed on photosensitive drum 2 by exposing an image of an original document, which is placed on an original table 4 made of transparent glass, via an optical system 5. Optical system 5 comprises an exposure lamp 5*a*, first, second, third reflecting mirrors 5*b*, 5*c*, 5*d*, a lens 5*e*, fourth, fifth and sixth reflecting mirrors 5*f*, 5*g* and 5*h*. The electrostatic latent image on photosensitive drum 2 is developed by applying a developing agent from a developing device 6 and is conveyed to a transfer charger 7. The design is such that a toner image T is transferred by actuating of transfer charger 7 onto a sheet of paper P, which has been fed either automatically or manually from paper supply cassettes 8 via paper supply rollers 9 and an aligning roller pair 10. Paper P is separated from drum 2 by a separation charger 11 using AC corona discharge.

After transferring the toner image onto paper P and separating it in this way, the residual developing agent on photosensitive drum 2 is cleaned off by a cleaning device 12. Then the potential on photosensitive drum 2 is set to a specified level or below by a discharge lamp 13 and is thus returned to a state in which the next copying operation is possible. After transferring, paper P is separated from photosensitive drum 2 and is conveyed towards a fixing device 20, which is concerned in the present invention and is described later, through a conveyance path 14. After the toner image T has been fixed by fixing device 20, paper P is dispensed onto a tray 17 by a discharge rollers 15 and 16.

Figure 2:
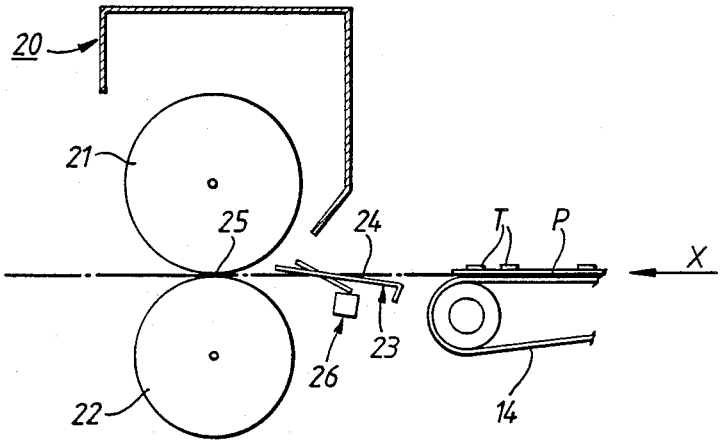
FIG. 2 is a side view of a fixing device according to an embodiment of the present invention.
Figure 3:
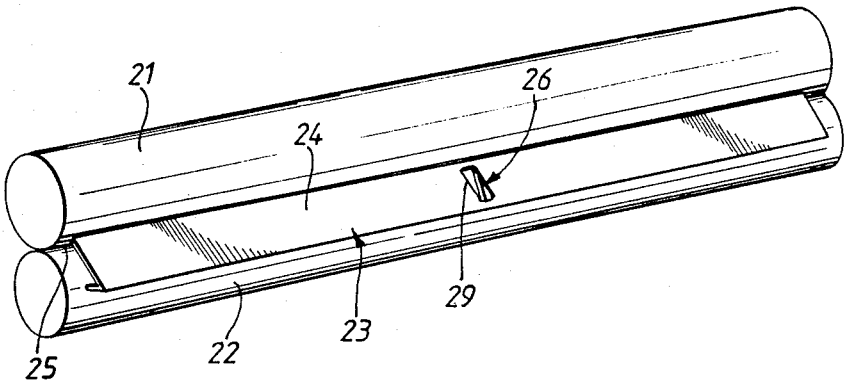
FIG. 3 is a perspective view of the fixing device of FIG. 2.

As shown in detail in FIGS. 2 and 3, the design of fixing device 20 is such that paper P which has been conveyed on conveyance path 14 is inserted to a nip portion 25 formed between a fixing roller 21 and a pressing roller 22 via a guide plate 23. Guide plate 23 made of a piece of sheet metal, has a guide surface 24. A slit-shaped opening 29 is formed in the vicinity of the center of the width direction of guide plate 23. The leading edge of guide plate 23 is arranged to incline upwards towards the line of conveyance direction X so that it is positioned close to nip portion 25. A thrust unit 26 is provided in the vicinity of the center of the width direction of guide plate 23 which pushes the leading edge of paper P upwards through opening 29.

Figure 4:
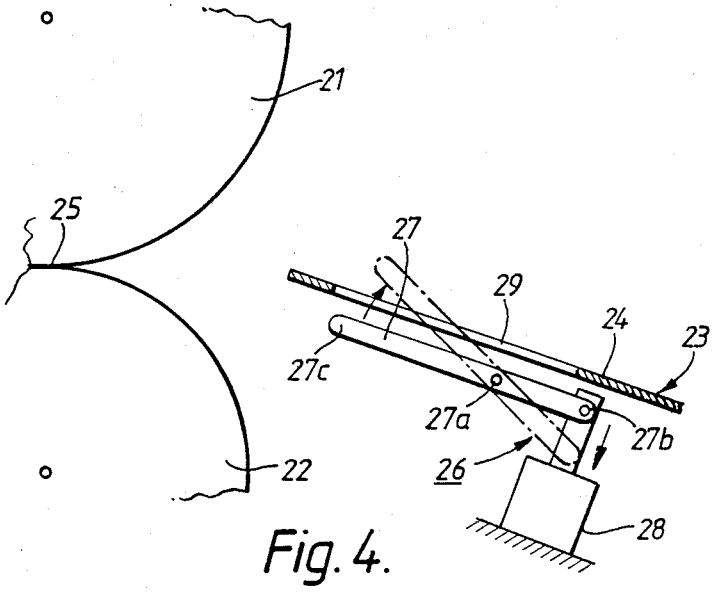
FIG. 4 is a schematic cross-sectional view of a part of the device of FIG. 2 showing the mechanism of a thrusting means.

As shown in FIG. 4, this thrust unit 26 is constructed in the following manner. A thrust lever 27 is provided to swingably rotate through a pivot 27*a*. A solenoid 28 connects to one end portion 27*b* of thrust lever 27 to swingably rotate thrust lever 27 through pivot 27*a*. The other end portion 27*c* of thrust lever 27 faces opening 29 formed in guide plate 23. By the rotation of thrust lever 27, end portion 27*c* of thrust lever 27 thrusts from guide surface 24 of guide plate 23 through opening 29 or retracts from guide surface 24 of guide plate 23 through opening 29. Thrust lever 27 is actuated in synchronization with the conveyance timing of paper P by switching solenoid 28 on and off.

Figure 5:
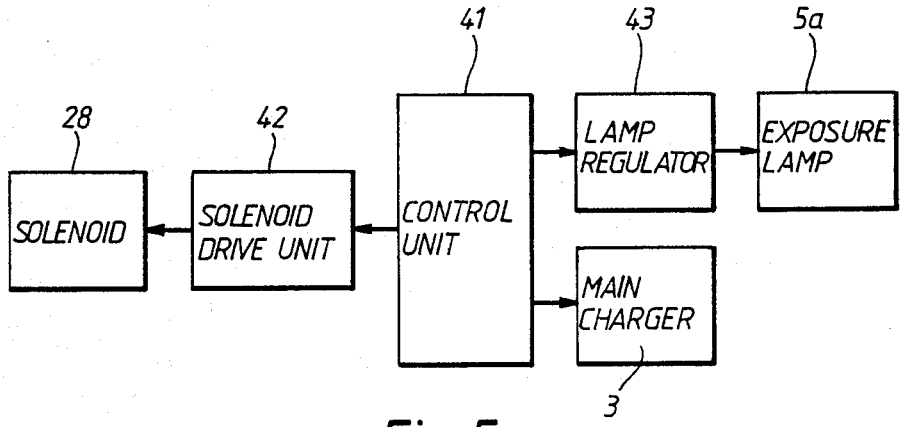
FIG. 5 is a schematic block diagram showing the control system.

FIG. 5 shows the essential parts of the control system. Control unit 41 controls the entire operation of the copying machine. A lamp regulator 43, main charger 3 and a solenoid drive unit 42 are respectively connected to control unit 41. Lamp regulator 43 connects with exposure lamp 5*a* to control the lighting of lamp 5*a*. Solenoid drive unit 42 connects with solenoid 28 to drive solenoid 28.

The timing of the actuating of thrust unit 26 is controlled by control unit 41 shown in FIG. 5. That is, the timing of the actuating of thrust unit 26 takes as its reference the timing of the commencement of rotation of aligning roller pair 10 which conveys the paper P remaining in the flat shape to the toner image transferring station. Solenoid 28 is turned on by control unit 41 through drive unit 42 after the passage of a predetermined time from the commencement time of the aligning roller pair's rotation to when the leading edge of paper P has reached thrust unit 26 via the toner image transferring station. At this time, paper P has been guided over guide plate 23. When the leading edge of paper P is fed into nip portion 25 between fixing roller 21 and pressing roller 22, solenoid 28 is turned off by control unit 41 through drive unit 42.

Figure 10A:
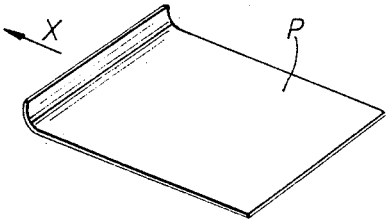
FIG. 10A is a perspective view showing a paper where the leading edge thereof is curled in the conveyance direction.
Figure 10B:
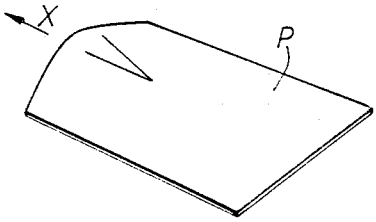
FIG. 10B is a perspective view showing a paper where the leading edge thereof is formed in a convex shape by using the thrusting means or pushing means according to the present invention.

When solenoid 28 is turned on at the above-mentioned timing, solenoid 28 moves thrust lever 27 to thrust upwards the end portion 27*c* of lever 27 from guide plate 23 through the opening 29. The leading edge of paper P which is curled in the conveyance direction, as shown in FIG. 10A, is forcibly corrected to form a convex shape, as shown in FIG. 10B. This makes it accurate for paper P to be fed into nip portion 25. In this condition, when the leading edge of paper P is fed into nip portion 25, solenoid 28 is turned off so that thrust lever 27 returns to its original position by rotating downwards.

Figure 6:
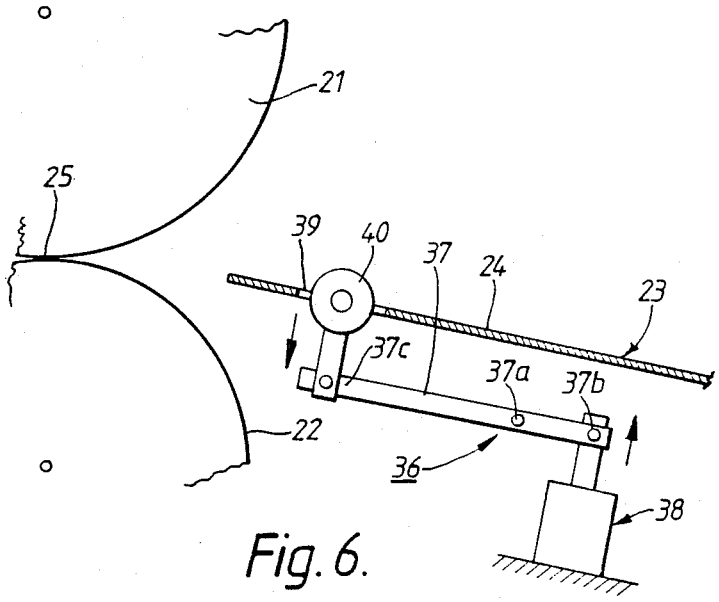
FIG. 6 is a schematic cross-sectional view of a part of the device of FIG. 2 showing the second embodiment of the mechanism of a thrusting means.

FIG. 6 shows a second embodiment according to the present invention. A thrust unit 36 is constructed in the following manner. A lever 37 is provided to swingably rotate through a pivot 37*a*. A solenoid 38 connects to one end portion 37*b* of lever 37 to swingably rotate lever 37 through pivot 37*a*. A roller 40 is rotatably mounted at the other end portion 37*c* and faces an opening 39 formed in guide plate 23. By the rotation of lever 37, roller 40 thrusts from guide surface 24 of guide plate 23 through opening 39 or retracts from guide surface 24 of guide plate 23 through opening 39. Lever 37 is actuated in synchronization with the conveyance timing of paper P by switching solenoid 38 on and off, in the same way as the first embodiment described above.

In this second embodiment, since roller 40 is used in thrust unit 36 for forming a convex shape at the leading edge of paper P, the conveyance of paper P on guide plate 23 to nip portion 25 can be smoothly carried out.

Next, the third embodiment of the present invention will be described with reference to FIGS. 7 to 9.

The design of a fixing device 20 is such that a paper P which has been conveyed on a conveyance path 14 is inserted to a nip portion 25 formed between a fixing roller 21 and a pressing roller 22 via a guide plate 23. Guide plate 23 is arranged at the entry side of roller pair 21 and 22. Guide plate 23 has flat plate shape and the width of plate 23 is slightly smaller than the width of paper P to form noncontact portions Pa of paper P on both sides of guide plate 23. Guide plate 23 is arranged to correspond to nip portion 25. Wheels 53 which compose presser members 52 are provided in the vicinity of both side edges of guide plate 23. Wheels 53 are rotatably mounted at one end of supporting arms 54, respectively. Each wheel 53 is formed in a star-shape, having a plurality of pointed portions around its circumference. These star-shaped wheels reduce the contact surface area between them and the paper. Supporting arms 54 are each secured at their mid portions 54*a* so that they are free to rotate and are designed to rotate freely in the direction of the arrow in FIGS. 8 and 9. In the state in which supporting arms 54 are rotated to the position shown by the solid lines in FIG. 9, wheels 53 are designed to be positioned below the surface 24 of guide plate 23, as shown in FIG. 8.

Figure 9:
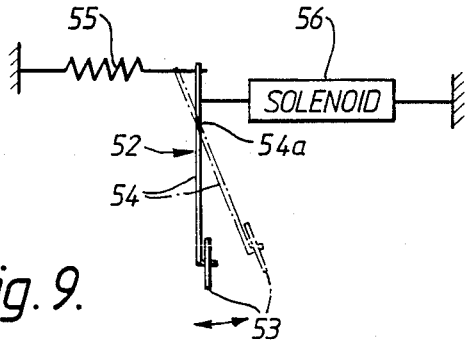

FIG. 9 shows the drive system for each supporting arm 54. A spring 55 is mounted at the other end of supporting arm 54, and by means of this spring 55 one end of supporting arm 54 is normally urged in a direction which separates it from guide plate 23. A solenoid 56 is also provided at the other end of supporting arm 54, and when this solenoid 56 is energized, it causes supporting arm 54 to resist the urging force of spring 55 and to rotate to the position shown by the solid lines in FIG. 9.

Figure 7:
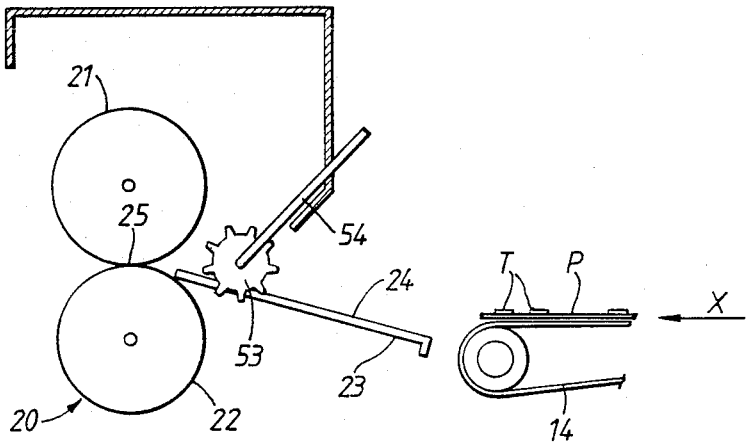
Figure 8:
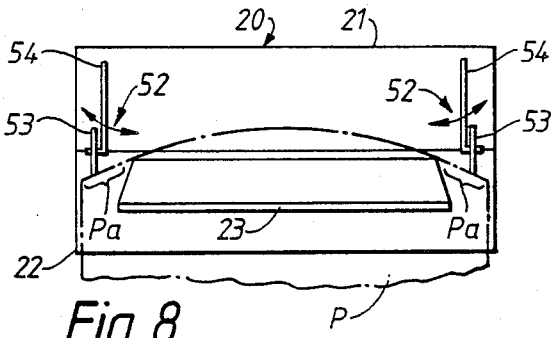
FIG. 8 is a front view of FIG. 7.

When solenoid 56 is turned on, wheels 53 are shifted to the positions shown in FIGS. 7 and 8. In this condition, when paper P is guided over guide plate 23, noncontact portions Pa of paper P are pushed downwards below guide plate 23 by wheels 53. Therefore, as shown by the dot-and-dash line in FIG. 8, that part of paper P which faces nip portion 25 is inserted between fixing roller 21 and pressing roller 22 by forming it into a convex shape so that it rises up. Consequently, where paper P which is inserted into nip portion 25 is concerned, since the center portion of paper P comes into contact with fixing roller 21 before the both side edges thereof, both side edges are inserted smoothly into nip portion 25.

When the leading edge of paper P has been inserted into nip portion 25, solenoid 56 is turned off and wheels 53 are separated from paper P by being rotated to the position shown by the dotted line in FIG. 9. Consequently, after this, paper P is guided by guide plate 23 and is passed through nip portion 25.

In this third embodiment, guide plate 23 is provided at the entrance to nip portion 25 formed between fixing roller 21 and pressing roller 22, and presser members 52 are provided which press both side edges of the paper which is guided by guide plate 23 below guide plate 23. By pressing both side edges of the paper which is conveyed on guide plate 23 with presser members 52, the paper is formed into a convex shape. Consequently, it is possible to prevent the occurrence of paper creases more effectively than in the past. Moreover, presser members 52 are designed to press only on the leading edge of the paper and to separate from the paper in the state in which the leading edge has been fed into nip portion 25. Consequently, it is possible to prevent deterioration of the picture quality on the paper since wheels 53 of presser members 52 do not come into contact with the unfixed toner image of the paper.

As described above, according to the present invention, a fixing device for an image forming apparatus can be provided which is capable of preventing creases occurring in an image forming medium by forming a convex shape at the leading edge of the image forming medium when the image forming medium is fed into a nip portion formed between a fixing roller and pressing roller.

Various other modifications could be made in the present invention without departing from the scope of spirit of the following claims.

What is claimed is:

1. A fixing device for an image forming apparatus, comprising:

first and second rollers forming a nip portion therebetween, the rollers transporting an image forming medium and fixing an image thereon;

means for conveying the image forming medium having a flat shape and a leading edge approaching the nip portion; and means for changing the shape of the leading edge of the image forming medium from the flat shape to a convex shape by thrusting against the leading edge in the vicinity of the center of the width of the image forming medium while the image forming medium approaches the nip portion.

2. The device of claim 1 wherein the conveying means includes a guide plate on which the image forming medium is led to the nip portion.

3. The device of claim 2 wherein the changing means includes means for upwardly thrusting the image forming medium on the guide plate.

4. The device of claim 3 wherein the thrusting means includes:

a lever having a middle portion and opposite end portions, the lever being movable on a fulcrum at the middle portion of the lever;

a roller rotatably mounted at one end portion of the lever; and a solenoid operatively connected with the other end portion of the lever to move the roller between a first position in which the roller projects from the guide plate through an opening formed in the guide plate so as to thrust the leading edge of the image forming medium and a second position in which the roller retracts from the guide plate through the opening.

5. A fixing device for an image forming apparatus, comprising:

first and second rollers for forming a nip portion therebetween, which rollers transport an image forming medium and fix an image thereon, the image forming medium having a flat shape and having a leading edge approaching the nip portion;

means for conveying the image forming medium, the conveying means including a guide plate on which the image forming medium is led to the nip portion; and means for upwardly thrusting to change the shape of the leading edge of the image forming medium from the flat shape to a convex shape while the image forming medium is conveyed on the guide plate to approach the nip portion by the conveying means, the thrusting means including a lever having a middle portion and opposite end portions, the lever being movable on a fulcrum, and a solenoid operatively connected to one end portion of the lever to move the other end portion of the lever between a first position in which the other end portion projects from the guide plate through an opening formed in the guide plate so as to thrust the leading edge of the image forming medium and a second position in which the other end portion retracts from the guide plate through the opening.

6. A fixing device for an image forming apparatus, comprising:

first and second rollers for forming a nip portion therebetween, which rollers transport an image forming medium and fix an image thereon, the image forming medium having a flat shape and having a leading edge approaching the nip portion;

means for conveying the image forming means, the conveying means including a guide plate having a predetermined width smaller than the width of the image forming medium to form portions of the image forming medium not in contact with the guide plate, the guide plate leading the image forming medium to the nip portion; and means for pushing downwardly the non-contact portions of the image forming medium below the guide plate to change the shape of the leading edge of the image forming medium from the flat shape to a convex shape while the image forming medium approaches the nip portion.

7. The device of claim 6 wherein the pushing means includes:

supporting arms respectively provided at the both sides of the guide plate, each having a middle portion and opposite end portions, the supporting arms being movable on a fulcrum at the middle portion of the supporting arms;

rotatable wheels respectively mounted at one end portion of the supporting arms; and solenoids respectively operatively connected with the other end of the supporting arms to move the rotatable wheels between a first position in which the wheels push one of the non-contact portions of the image forming medium and a second position in which the wheels separate from one of the non-contact portions of the image forming medium.

* * * * *